US006795665B2

(12) United States Patent
Miura

(10) Patent No.: US 6,795,665 B2
(45) Date of Patent: Sep. 21, 2004

(54) IMAGE FORMING APPARATUS AND SHEET PROCESSING APPARATUS WITH A SERIAL CONNECTION

(75) Inventor: Shigeo Miura, Tokyo (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/213,285

(22) Filed: Aug. 6, 2002

(65) Prior Publication Data

US 2003/0063918 A1 Apr. 3, 2003

(30) Foreign Application Priority Data

Aug. 6, 2001 (JP) ..... 2001-238262
Aug. 2, 2002 (JP) ..... 2002-225998

(51) Int. Cl.[7] ..... G03G 15/00
(52) U.S. Cl. ..... 399/90
(58) Field of Search ..... 399/90, 75, 88, 399/37, 13, 12

(56) References Cited

FOREIGN PATENT DOCUMENTS

JP 4-316880 * 11/1992
JP 2002-258691 * 9/2002

* cited by examiner

*Primary Examiner*—Quana Grainger
(74) *Attorney, Agent, or Firm*—Rossi & Associates

(57) ABSTRACT

A sheet processing apparatus and an image forming apparatus are provided, which make it possible to determine whether the sheet processing apparatus is attached to the image forming apparatus in a short time and without increasing the number of signal lines. The sheet processing apparatus that is attached to the image forming apparatus includes a controller that controls the sheet processing apparatus and a serial communication line that performs serial communication from the controller to the image forming apparatus, with the controller operating in response to supplying of power to the controller to set the serial communication line at a high level. The image forming apparatus to which the sheet processing apparatus is attached includes a controller that controls the image forming apparatus and a serial communication line that performs serial communication from the sheet processing apparatus to the controller of the image forming apparatus, with the controller determining, in response to supplying of power to the sheet processing apparatus, whether the serial communication line of the image forming apparatus is at the high level and determining that the sheet processing apparatus is attached when the serial communication line is at the high level.

19 Claims, 13 Drawing Sheets

IMAGE FORMING APPARATUS AND SHEET PROCESSING APPARATUS WITH A SERIAL CONNECTION

BACKGROUND OF THE INVENTION

1. Field of the Invention

The present invention relates to an image forming apparatus and a sheet processing apparatus that perform serial communication with one another.

2. Description of the Related Art

Conventionally, serial communication is normally used for communication between an image forming apparatus and a sheet processing apparatus (finisher). In this case, three-wire serial communication is used between the conventional image forming apparatus and the finisher, with a controller (ECONT) for controlling image forming operations by the image forming apparatus on the master side. The three-wire serial communication lines are composed of a serial communication line from the image forming apparatus to the finisher, a serial communication line from the finisher to the image forming apparatus, and a clock signal line for serial communication from the image forming apparatus to the finisher. When there are signals that cannot be handled by such three-wire serial communication, other communication lines are separately provided between the image forming apparatus and the finisher.

A finisher is usually designed as an option to be connected to an image forming apparatus, so that the image forming apparatus needs to determine whether a finisher has been provided. A configuration where the image forming apparatus is provided with separate signal lines for determining whether options have been connected is conventionally known, though this means that in addition to the three-wire serial communication lines described above, extra signal lines have to be provided for detecting options. Increasing the number of signal lines leads to increases in the cost of the connectors that connect the cables between the image forming apparatus and the finisher. Also, for ease of mounting, a number of connectors are used to connect the cables between the image forming apparatus and the finisher, so that increases in the cost per connector cannot be ignored for the apparatus as a whole. Furthermore, there is a tendency for the amount of noise, which is radiated from serial communication lines due to the antenna effect of the signal lines, to increase in keeping with the number of signal lines. It is also necessary to provide a CPU of the image forming apparatus with a port for inputting signals from the signal lines for detecting options, which suppresses the freedom with which the ports can be used for the CPU even though the CPU itself is often subject to restrictions regarding the number of ports.

A configuration is known where predetermined communication for device detection is performed between the image forming apparatus and optional devices so that the image forming apparatus can judge whether options are provided, though with this configuration the image forming apparatus cannot judge instantly whether options are provided. Conventionally, it is judged whether options have been provided every time the power of the image forming apparatus is switched on, though since the starting up of the image forming apparatus itself takes time, the communication time taken to judge whether options are provided has not been a problem compared to the time taken by the starting up of the image forming apparatus. However, in recent years, to reduce power consumption, image forming apparatuses have been designed so as to frequently switch to power saving mode and the startup time of image forming apparatuses has been reduced. Since it is necessary to detect whether options are connected whenever an image forming apparatus returns from power saving mode, if an image forming apparatus judges whether options are attached by communicating with the options in the conventional manner, it is not possible for the image forming apparatus to quickly start up from the power-saving mode.

SUMMARY OF THE INVENTION

The present invention has been devised in view of the above described problem, and it is an object of the present invention to provide a sheet processing apparatus and an image forming apparatus, which make it possible to determine whether the sheet processing apparatus is attached to the image forming apparatus in a short time and without increasing the number of signal lines.

To attain the above object, in a first aspect of the present invention, there is provided a sheet processing apparatus to be attached to an image forming apparatus, comprising a controller that controls the sheet processing apparatus, and a serial communication line that performs serial communication from the controller to the image forming apparatus, wherein the controller is responsive to supplying of power to the controller, for setting the serial communication line at a high level.

In a preferred form, the sheet processing apparatus according to the first aspect comprises a resistor, and a first switching element, and wherein the serial communication line is disposed such that a voltage is applied to the serial communication line via the resistance, the serial communication line is grounded via the first switching element, and the controller controls the first switching element.

Preferably, the controller sets the serial communication line at the high level by turning off the first switching element.

More preferably, the controller performs serial communication with the image forming apparatus by turning the first switching element on and off.

Preferably, the first switching element comprises a transistor.

Also preferably, the serial communication line is disposed relative to the image forming apparatus such that a voltage of a power supply supplied by the image forming apparatus is applied to the serial communication line via the resistance.

Further preferably, the sheet processing apparatus according to the first aspect comprises a second switching element, and wherein power supplied from the image forming apparatus is supplied to the controller and the serial communication line via the second switching element, and wherein the second switching element is controlled in accordance with a signal on a power supply control signal line from the image forming apparatus.

Advantageously, the second switching element comprises a field effect transistor (FET).

Also advantageously, the sheet processing apparatus according to the first aspect further comprises a second serial communication line that performs serial communication from the image forming apparatus to the controller.

Preferably, the image forming apparatus is responsive to supplying of the power to the controller, for determining whether the serial communication line is at the high level, and determines that the sheet processing apparatus is attached when the serial communication line is at the high level.

Also preferably, the image forming apparatus judges whether the serial communication line is at the high level after a predetermined time period has passed after the power has been supplied to the controller.

To attain the above object, in a second aspect of the present invention, there is also provided an image forming apparatus to which the above described sheet processing apparatus is attached, the image forming apparatus comprising a second controller that controls the image forming apparatus, wherein the serial communication line performs serial communication from the sheet processing apparatus to the second controller, and wherein the second controller is responsive to supplying of power to the sheet processing apparatus, for determining whether the serial communication line is at a high level, and determines that the sheet processing apparatus is attached when the second serial communication line is at the high level.

Preferably, the second controller determines whether the serial communication line is at the high level after a predetermined time period has passed after the power has been supplied to the sheet processing apparatus.

Also preferably, the image forming apparatus according to the second aspect comprises a power supply control signal line, and wherein the second controller controls supplying of the power to the sheet processing apparatus via the power supply control signal line, and wherein the second controller determines whether the serial communication line is at the high level after instructing the supplying of the power to the sheet processing apparatus via the power supply control signal line.

More preferably, upon returning from a power saving mode, the second controller instructs the supplying of the power to the sheet processing apparatus via the power supply control signal line and then determines whether the serial communication line is at the high level.

Advantageously, the image forming apparatus according to the second aspect further comprises a second serial communication line that performs serial communication from the second controller to the sheet processing apparatus.

The above and other objects, features and advantages of the invention will become more apparent from the following detailed description taken in conjunction with the accompanying drawings.

DETAILED DESCRIPTION OF THE PREFERRED EMBODIMENTS

As a sheet processing apparatus which is connected to an image forming apparatus, aside from a finisher that stacks recording sheets, shifts recording sheets, or staples recording sheets together, as used in embodiments of the present invention, the present invention can also be effectively applied to an accessory apparatus, such as a sorter that sorts recording sheets, and a filing apparatus that gathers and files a plurality of recording sheets, which is connected to the discharge system of an image forming apparatus. The present invention can also be effectively applied to an interface for an accessory that is equipped with a high performance CPU. Further, in the embodiments described below, a paper-full detecting sensor for detecting whether a discharge tray is full of recording sheets is removed when the finisher is attached to the image forming apparatus, and it is determined that the discharge tray is full of recording sheets in accordance with special logic that is set in advance for the case where the paper-full detecting sensor has been removed, and control is provided such that recording sheets are not discharged to the finisher. However, it may be constructed such that a controller of the image forming apparatus performs control such that recording sheets are not discharged to a finisher when the sensor is removed and the detection as to whether the discharge tray is full of recording sheets is not carried out when the finisher has been attached to the image forming apparatus.

Figure 1:
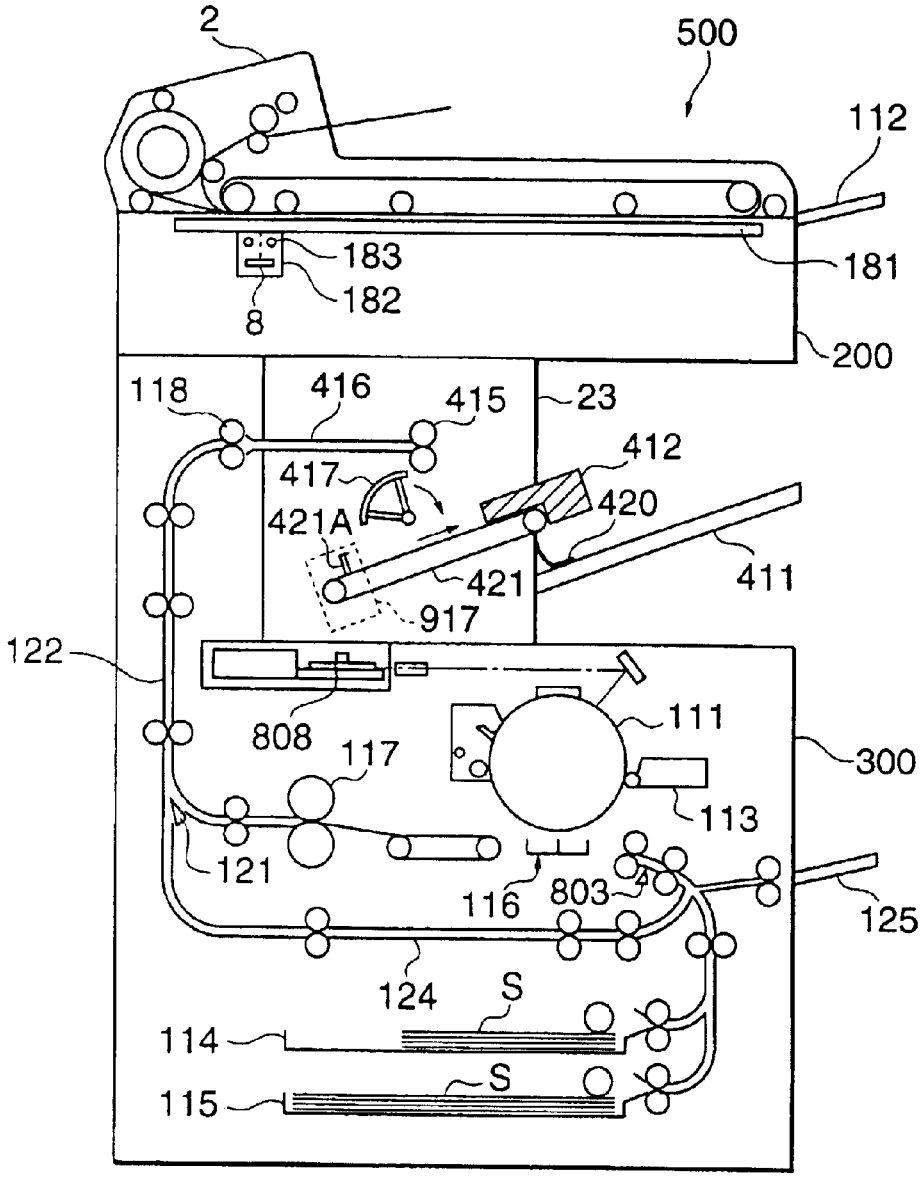
FIG. 1 is a cross-sectional view of an image forming apparatus and a finisher according to an embodiment of the present invention.

The present invention will now be described in detail with reference to the accompanying drawings showing preferred embodiments thereof. FIG. 1 is a diagram showing the construction of an image forming apparatus equipped with a finisher according to an embodiment of the present invention. In the figure, reference numeral 500 designates the image forming apparatus. The image forming apparatus 500 includes an image reader 200 and a printer 300, and is also equipped with a finisher 23 that is disposed between the image reader 200 and the printer 300 that is an image forming unit.

The image reader 200 is provided with a scanner unit 182 and an automatic original feeder 2, with the automatic original feeder 2 separating one sheet at a time in order from a top of original sheets that have been set face up and feeding the original sheet leftwards so as to convey the sheet via a curved path onto a platen glass 181 while also discharging original sheets that have been read onto a discharge tray 112.

The scanner unit 182 is provided with a lamp 183 that emits light onto an original that has been conveyed onto the platen glass 181, and once the light emitted onto the original by the lamp 183 has been reflected off the sheet, an image of the original is read by a contact sensor 8.

On the other hand, the printer 300 is equipped with a laser unit 808 for outputting laser light in accordance with an original image that has been read by the contact sensor 8 and subjected to image processing. The laser light emitted by the laser unit 808 strikes a photosensitive drum 111 and forms an electrostatic latent image on the photosensitive drum 111. After this, the electrostatic latent image on the photosensitive drum 111 is developed by a developer 113 to become a toner image, and this toner image is transferred by a transfer unit 116 onto a sheet that has been fed from any of sheet feed cassettes 114, 115, a manual sheet feed unit 125, or a two-sided conveying path 124.

It should be noted that when a sheet onto which a toner image has been transferred in this way passes a fixing unit 117, the sheet is subjected to a fixing process and is guided past the fixing unit 117 to discharge rollers 118, which discharge the sheet from the printer 300 with the transferred toner image-formed surface facing downwards (i.e., the sheet is discharged face down). By discharging sheets in a face-down manner in this way, when image formation is preformed in order starting from the first page, such as when the automatic original feeder 2 is used or when images outputted by a computer are printed, the discharged recording sheets are arranged in the correct order. It should be noted that when two-sided image forming is performed, a sheet that passes the fixing unit 117 is guided to a discharge path 122 by a flapper 121, and switched back and guided to the two-sided conveying path 124, with an image then being formed on the back of the sheet by the operation described above.

On the other hand, the sheets that have been discharged in this way by the discharge rollers 118 are fed into the finisher 23. It should be noted that in the present embodiment, the finisher 23 is a device that performs a stapling (binding) operation on sheets.

The sheets received from the printer 300 are fed via a path 416 to discharge rollers 415, with the discharge rollers 415 then discharging the sheets onto a slanted bundle discharge belt 421. After the sheets have been discharged onto a low-friction intermediate processing tray that is a sheet gathering means (not shown in the figure), the bundle discharge belt 421 discharges the sheets (bundle) that have been subjected to a stapling process by a stapling unit 917. It should be noted that the intermediate processing tray is disposed parallel with and several millimeters higher than the bundle discharge belt 421.

The bundle discharge belt 421 includes a bundle discharge lever 421A and when the bundle discharge belt 421 rotates, the bundle of sheets that has been subjected to the stapling process is pushed in the right upward direction by the bundle discharge lever 421A so as to be discharged onto a stack tray 411 that has moved to a predetermined loading position. It should be noted that the stack tray 411 can rise and fall in accordance with the loaded amount of sheets.

In FIG. 1, reference numeral 417 designates a fan-shaped return roller that is a first matching means. The return roller 417 rotates and comes into contact with the sheets discharged onto the intermediate processing tray, so as to move the sheets in the left downward direction. Reference numeral 412 indicates matching plates that form a second matching means for lining up both side edges of the sheets on the intermediate processing tray, with the plates being disposed at near and far locations in the depth direction of FIG. 1.

Figure 2:
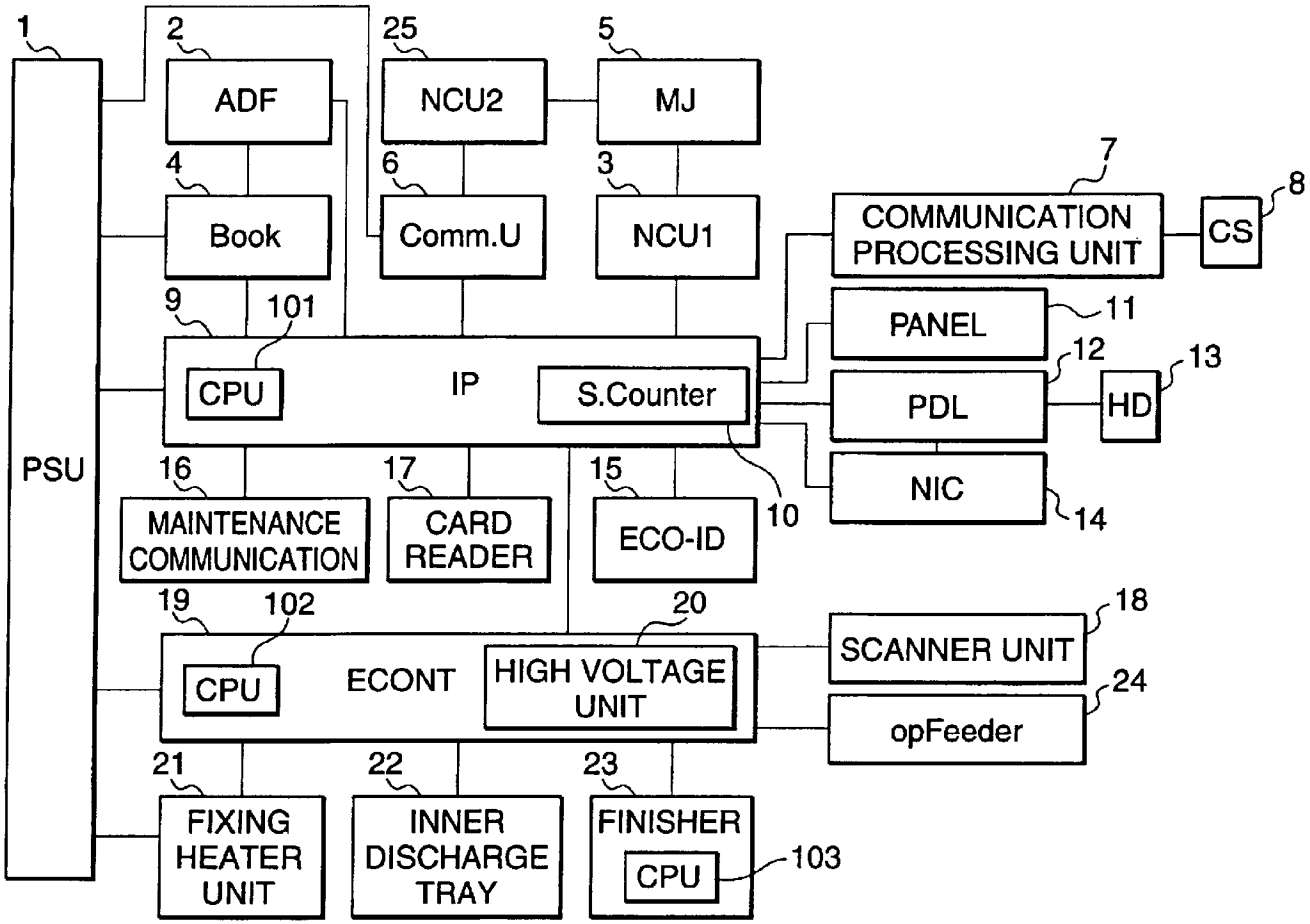
FIG. 2 is a block diagram showing the overall construction of the image forming apparatus and option devices.

FIG. 2 is a block diagram showing the overall construction of the image forming apparatus 500 and option devices according to the present embodiment. In FIG. 2, reference numeral 1 designates a power supply unit (PSU) that supplies a voltage to the image forming apparatus 500 and the option devices. Reference numeral 2 designates the automatic original feeder (ADF) that feeds a plurality of originals that have been set on the image forming apparatus 500 one sheet at a time to an original reading position on a platen. Reference numeral 3 designates a network control unit (NCU) that performs communication. Reference numeral 4 designates a BOOK unit that controls the reading of originals. Reference numeral 5 designates a modular jack (MJ) 5 for connection with networks. Reference numeral 6 designates a communication unit as an option device that performs simultaneous communication with two networks. Reference numeral 7 designates an image processing unit that processes images outputted by the contact sensor 8.

Reference numeral 9 designates a controller (IP) that controls parts of the entire system (the image forming apparatus 500 and the option devices) aside from the image forming (recording) system, with a CPU 101 in charge of such control. Reference numeral 10 designates a serial counter that stores the number of sheets printed by the image forming apparatus 500 (which is a printer, a copier, or a multi-function apparatus). Reference numeral 11 designates an operation unit that is comprised of a display means, which displays a state of the image forming apparatus 500 to the user, and a key input means, which the user operates to determine the operation of the image forming apparatus 500. Reference numeral 12 designates a page description language (PDL) processing unit, or in other words, a formatter, that, for example, converts character codes that have been received from an external device via a network into image data that can be printed by the image forming apparatus 500.

Reference numeral 13 designates a hard disk drive that is used for loading and storing data that has been received from an external device via a network. Reference numeral 14 designates a network interface card (NIC) that provides an interface with a network. Reference numeral 15 designates an ECO-ID card that includes a storage medium that stores information from the serial counter 10 on the outside to thereby protect any loss in the number of sheets printed by the image forming apparatus 500 (a printer, copier, or multi-function apparatus) due to tampering or the like. Reference numeral 16 designates a maintenance communication unit that exchanges maintenance information with the image forming apparatus 500 via a card or a public telephone line. Reference numeral 17 designates a card reader that can read management information from a detachable card that stores management information used in the case where the image forming apparatus 500 is managed separately for each department in an enterprise, for example.

Reference numeral 18 designates a scanner unit that reads an original image in order for an image to be formed on the photosensitive drum 111. Reference numeral 19 designates a controller (ECONT) that controls image formation (recording), with a CPU 102 in charge of such control. Reference numeral 20 designates a high-voltage unit that produces a high voltage signal for having toner applied onto the photosensitive drum 111 in accordance with the formed (recorded) image and transferring the toner image onto a recording sheet. Reference numeral 21 designates a fixing heater unit that is provided with the fixing unit 117 for fixing the toner that is attached to the recording sheet using heat and pressure. It should be noted that the developing system, transfer system, fixing system, etc., including the photosensitive drum 111, constitute the image forming unit. Reference numeral 22 designates an inner discharge tray that is optionally provided for sorting recording sheets onto which images have been formed (recorded). Reference numeral 23 designates a recording sheet processing device (finisher) that can be detachably attached to the image forming apparatus 500, and is controlled by a CPU 103. Reference numeral 24 designates an option feeder that can be attached as an option to the image forming apparatus 500 provided that the finisher 23 is not attached at the same time. Reference numeral 25 designates a network control unit (NCU) for a second network.

Figure 3:
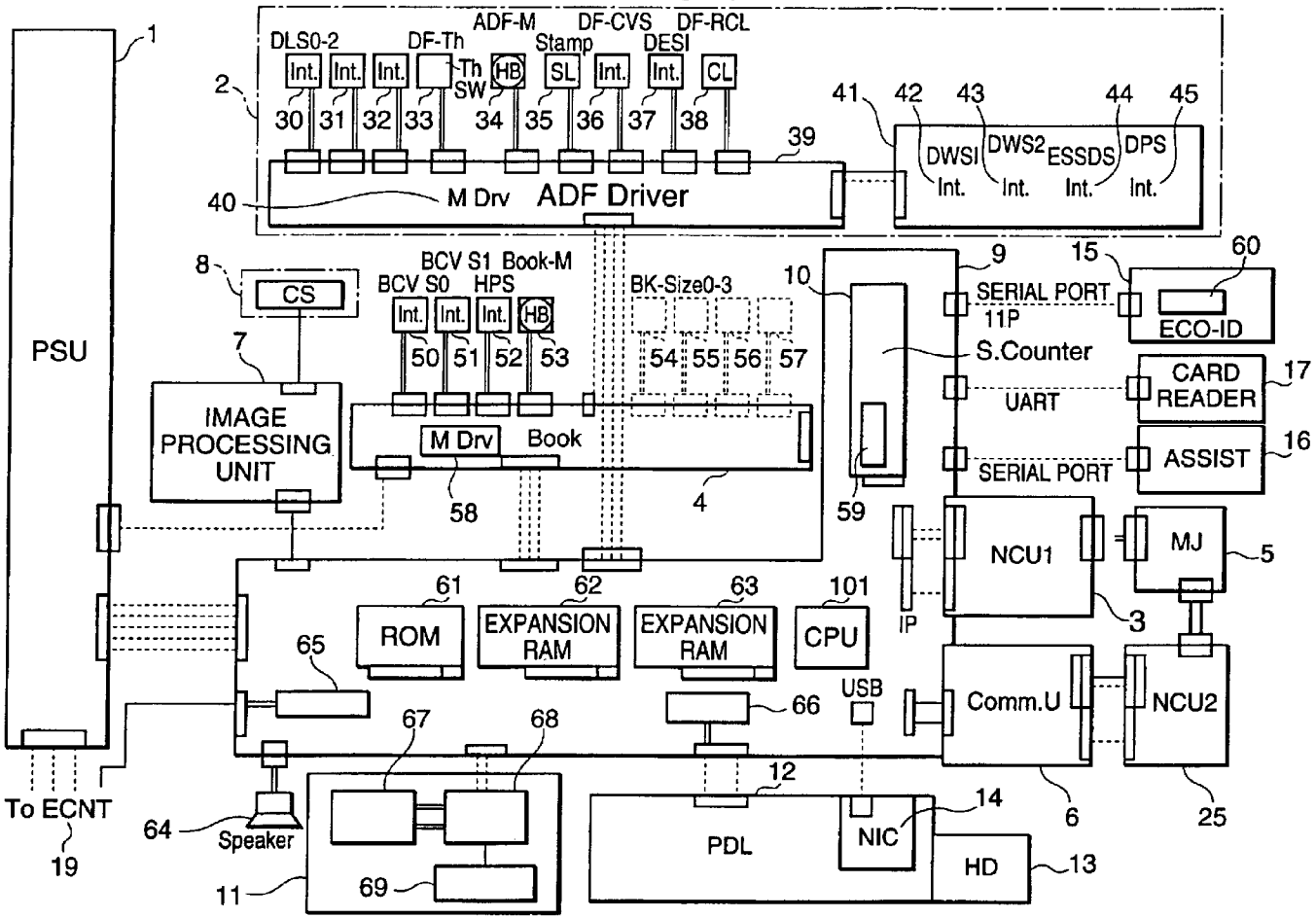
FIG. 3 is a block diagram showing the construction of an IP 9 of the image forming apparatus and its related components.

FIG. 3 is a block diagram showing the construction of the controller IP 9 of the image forming apparatus and its related components for controlling the entire system comprised of the image forming apparatus 500 and option devices according to this present embodiment. It should be noted that elements and parts of FIG. 3 that are the same as in FIG. 2 are designated by identical reference numerals and description thereof is omitted. In FIG. 3, reference numeral 30 to 32 are original length sensors for detecting the length of the originals on the ADF 2. Reference numeral 33 designates a thermistor for detecting the temperature at a predetermined location. Reference numeral 34 designates an original feeding motor for feeding originals that are set on the ADF 2. Reference numeral 35 designates a confirmation stamp that is pressed onto fax originals that have been transmitted from this image forming apparatus 500 to an external device. Reference numeral 36 designates a cover sensor for detecting whether the cover for setting originals on the ADF 2 is open. Reference numeral 37 designates an original edge sensor for detecting an edge of an original, and is disposed just before the original reading unit.

Reference numeral 38 designates a clutch for pulling originals towards a reading position. Reference numeral 39 designates an ADF driver for driving the ADF 2. Reference numeral 40 designates a motor driver for driving the original feeding motor 34. Reference numeral 41 designates a sensor baseplate on which various sensors 42 to 45 are mounted. Reference numerals 42 and 43 designate original width sensors for detecting the width of originals. Reference numeral 44 designates an original sensor for detecting whether there is an original on the ADF 2. Reference numeral 45 designates a sensor that is disposed between the original sensor 44 and the original edge sensor 37 and is used for measuring timing in which the original reading unit is driven. Reference numerals 50, 51 designate sensors for detecting, when a pressing plate for pressing the original or an ADF 2 for feeding originals is present on the platen, whether the pressing plate or ADF 2 has been opened.

Reference numeral 52 designates a home position sensor for detecting whether the contact sensor (CS) 8 is in a home position thereof. Reference numeral 53 designates a CS driving motor for driving the CS 8. Reference numerals 54 to 57 designate sensors for detecting the size of an original placed on the platen in the case where the states of the sensor 50 and the sensor 51 show that the pressing plate or the ADF 2 has been opened by a certain degree. Reference numeral 58 designates a motor driver for driving the CS driving motor 53. Reference numeral 59 designates an EEPROM that is a memory element of the serial counter 10. Reference numeral 60 designates an EEPROM that is a memory element of the ECO-ID card 15. Reference numeral 61 designates a ROM for deciding the operation of the IP 9. Reference numerals 62, 63 designate expansion RAMs for storing image signals and the like. Reference numeral 64 designates a speaker for emitting sounds. Reference numeral 65 designates a differential amplifier for sending print video data to the ECONT 19. Reference numeral 66 designates a differential amplifier for receiving print video data from the PDL processing unit 12. Reference numeral 103 designates the CPU of the IP 9.

Figure 4:
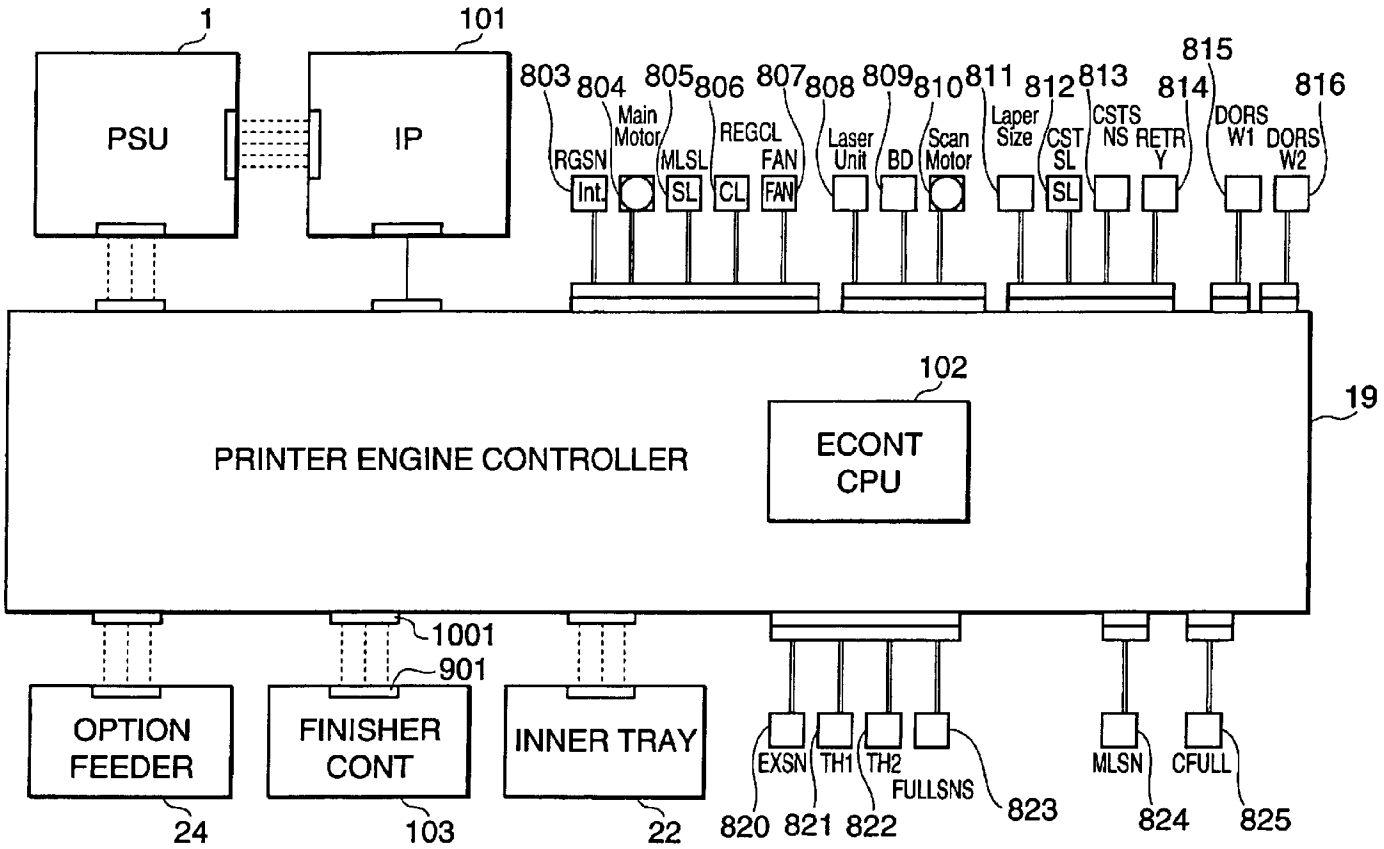
FIG. 4 is a block diagram showing the construction of an ECONT 19 of the image forming apparatus and its related components.

FIG. 4 is a block diagram showing the construction of the controller (ECONT) 19, which controls image forming operations by the image forming apparatus 500 according to the present embodiment, and electronic components in the periphery of the ECONT 19. It should be noted that elements and parts that are the same as in FIGS. 2 and 3 are designated by reference numerals and description thereof is omitted. In FIG. 4, reference numeral 803 is a pre-resist sensor for detecting that the recording sheet is just before the photosensitive drum. Reference numeral 804 designates a main motor for driving the entire image forming (recording) unit. Reference numeral 805 designates a manual paper feed solenoid for picking up a recording sheet that is inserted from the manual sheet feed unit 125. Reference numeral 806 designates a resist clutch for pulling paper, when the paper is caught on the pre-resist sensor 803, so as to flex the paper by a certain degree. Reference numeral 807 designates a fan motor for circulating air in order to lower the temperature of mechanisms that emit heat inside the image forming apparatus 500.

Reference numeral 808 designates a laser unit for irradiating a laser beam onto the photosensitive drum. Reference numeral 809 designates a beam detection sensor for detecting the synchronization timing of the scanning of the laser in the horizontal direction. Reference numeral 810 designates a scanner motor for scanning the laser. Reference numeral 811 designates a paper size switch for detecting the size of the recording sheets stored in the sheet feed cassettes inside the image forming apparatus 500. Reference numeral 812 designates a solenoid for picking up a recording sheet stored in one of the internal sheet feed cassettes 114 and 115 when paper is fed. Reference numeral 814 designates a retry sensor for detecting when a recording sheet picked up from the sheet feed cassette 114 or 115 has not reached a predetermined position and outputting a signal to the ECONT 19 for retrying the picking up of a recording sheet.

Reference numerals 815 and 816 designate door sensors for detecting when front doors provided in the image forming apparatus 500 for maintenance purposes are open. Reference numeral 24 designates a cassette feeder that is attached to the image forming apparatus 500 as an option. Reference numeral 23 designates a recording sheet processing apparatus (finisher) that can be detachably attached to the image forming apparatus 500. Reference numeral 22 designates an inner discharge tray that is attached to the image forming apparatus 500 as an option. Reference numeral 820 designates a discharge sensor for detecting whether a recording sheet has been discharged. Reference numerals 821 and 822 designate thermistors for detecting the temperature of the fixing heater unit 21. Reference numeral 823 designates a paper-full detecting sensor that is disposed downstream of the recording sheet discharging system and when the finisher 23 is not attached to the image forming apparatus 500, detects whether the discharge tray is full of recording sheets. The paper-full detecting sensor 823 is removed when the finisher 23 is attached to the image forming apparatus 500. Reference numeral 824 designates a sensor for detecting whether a recording sheet or sheets are present on the manual sheet feed unit. Reference numeral 825 is a used toner full detection sensor for detecting whether a used toner vessel is full. Reference numeral 102 designates the CPU of the ECONT 19.

Figure 5:
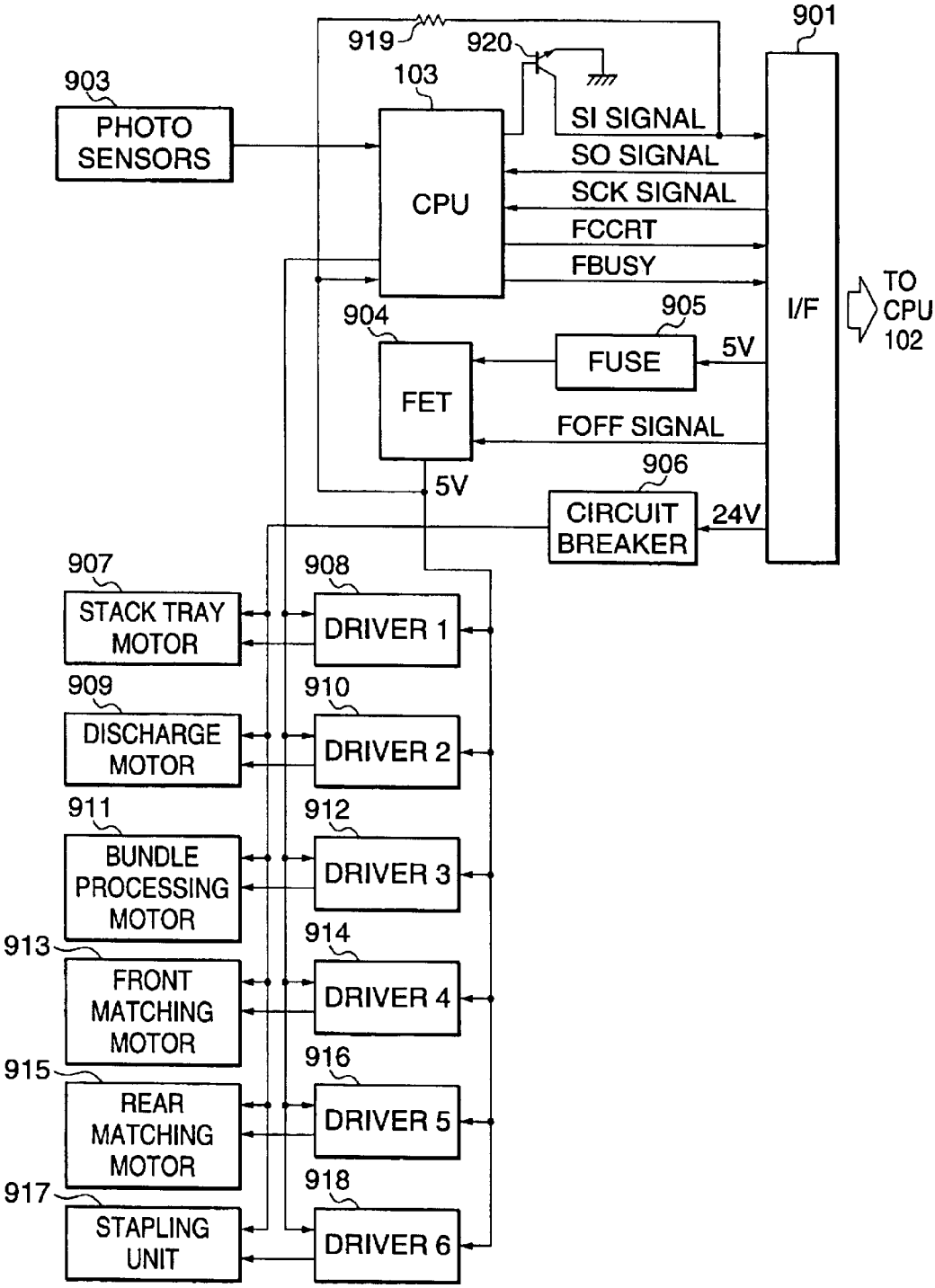
FIG. 5 is a block diagram for the control of the finisher 23 according to the embodiment of the present invention.

FIG. 5 is a block diagram showing the construction of the finisher 23 that can be detachably attached to the image forming apparatus 500 according to the present embodiment. In FIG. 5, reference numeral 901 designates an interface for transmitting and receiving a variety of signals between the finisher 23 and the image forming apparatus 500. Reference numeral 103 designates the CPU that controls the various parts of the finisher 23. Reference numeral 903 designates a plurality of photosensors provided within the finisher 23, for performing various detections. Reference numeral 904 designates a field effect transistor (FET) that is disposed between the CPU 103 and various drivers, described below, and the interface 901, with a FOFF signal from the image forming apparatus 500 being inputted to the FET 904 via the interface 901. Reference numeral 905 designates a fuse for limiting the electric current. Reference numeral 906 designates a circuit breaker for limiting the electric current.

The interface 901 serves as an interface for an SI signal, an SO signal, an SCK signal, FCCRT, FBUSY, and an FOFF signal. The SI signal is for serial communication from the CPU 103 to CPU 102, while the SO signal is for serial communication from the CPU 102 to CPU 103. The SCK signal is a clock for the serial communication performed using the SI signal and the SO signal. FCCRT designates a signal expressing whether or not there is information from the finisher 23. FBUSY designates a signal expressing whether the CPU 103 is capable of communication. The FOFF signal is a signal for switching the FET 904 on and off. Also, a 5V supply and a 24V supply are provided to the finisher 23 via the interface 901.

When the FOFF signal is on, the FET 904 provides the 5V supply provided via the interface 901 and the fuse 905 to the CPU 103, a resistor 919, a driver 908, a driver 910, a driver 912, a driver 914, a driver 916, and a driver 918. The CPU 103, when provided with the 5V supply from the FET 904, turns the transistor 920 off. When the transistor 920 is turned off, the voltage of the SI signal is set at a high level. That is, when the 5V supply is provided from the FET 904, the CPU 103 pulls up the SI signal to a high level.

Accordingly, after the FOFF signal has switched from off to on, the CPU 102 that controls the image forming apparatus 500 can instantly detect whether the finisher 23 has been attached to the image forming apparatus 500 by judging whether the SI signal is at the high level. This is to say, after the FOFF signal has switched from off to on, the CPU 102 judges that the finisher 23 is attached to the image forming apparatus 500 when the SI signal is at the high level and that the finisher 23 is not attached to the image forming apparatus 500 when the SI signal is at the low level. It should be noted that after judging from the level of the SI signal that the finisher 23 is attached, the CPU 102 receives serial communication from the CPU 103 from the SI signal.

With this arrangement, there is the advantage that there is no need to provide the interface 901 with a line for judging whether the finisher 23 is attached. Since the number of lines in the interface 901 is thus prevented from increasing, more inexpensive connectors can be used as the interface 901. When the finisher is implemented as an actual product, the CPU 102 and the CPU 103 are connected via a plurality of connectors, and therefore, even if the reduction in the cost per connector is smaller, this leads to a large reduction in the cost per apparatus. Also, the number of signal lines that generate antenna effects is reduced by the reduction in the number of communication lines between the CPU 102 and the CPU 103, so that there is a further advantage in that increases in noise from the communication lines can be decreased. There is also no need to provide the CPU 102 with a port for judging whether the finisher 23 is attached, so that part of the limited number of ports that are provided on the CPU can be assigned to other functions.

Since a response from the CPU 103 to a communication from the CPU 102 is not required in order to judge whether the finisher 23 is attached, whenever necessary the CPU 102 can instantly judge whether the finisher 23 is attached. As a result, when the image forming apparatus 500 is started from power saving mode, the image forming control, which is performed in accordance with the attachment state of the finisher 23, can be commenced in a short time.

Reference numeral 907 designates a stack tray motor for raising and lowering the stack tray 411. Reference numeral 908 designates a driver IC for driving the stack tray motor 907. Reference numeral 909 designates a discharge motor for driving the discharge rollers 415 that pulls a recording sheet, which has been discharged from the image forming apparatus 500, into the finisher 23 and conveys the recording sheet towards the bundle discharge belt 421 (the intermediate processing tray). Reference numeral 910 designates a driver IC for driving the discharge motor 909. Reference numeral 911 designates a bundle processing motor for driving the bundle discharge belt 421. Reference numeral 912 designates a driver IC for driving the bundle processing motor 911. Reference numeral 913 designates a front-matching motor for driving the inside matching plate 412 in order to align the recording sheets with the front limit. Reference numeral 914 designates a driver IC for driving the front-matching motor 913. Reference numeral 915 designates a rear-matching motor for driving the nearside matching plate 412 in order to align the recording sheets with the rear limit. Reference numeral 916 designates a driver IC for driving the rear-matching motor 915. Reference numeral 917 designates a stapling unit for stapling the recording sheets. Reference numeral 918 designates a driver IC for driving the stapling unit 917.

Figure 6:
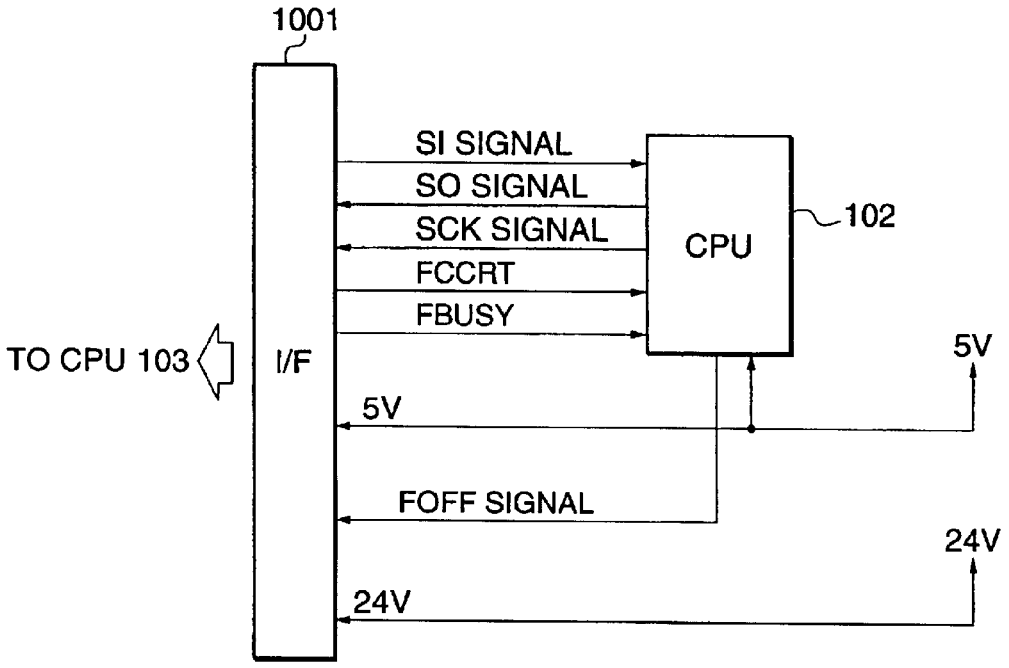
FIG. 6 is a block diagram of the arrangement of components of the image forming apparatus 500 for the control of the apparatus according to the embodiment of the present invention.

FIG. 6 is a block diagram showing the construction of the image forming apparatus 500 according to the present embodiment. In FIG. 6, reference numeral 1001 designates an interface for transmitting and receiving a variety of signals between the finisher 23 and the image forming apparatus 500. The interface 1001 serves as an interface for the SI signal, the SO signal, the SCK signal, FCCRT, FBUSY, and the FOFF signal described earlier. Reference numeral 102 designates the CPU that is in charge of the control of the various components of the image forming apparatus 500. A 5V supply and a 24V supply are provided to the finisher 23 via the interface 1001.

Figure 7:
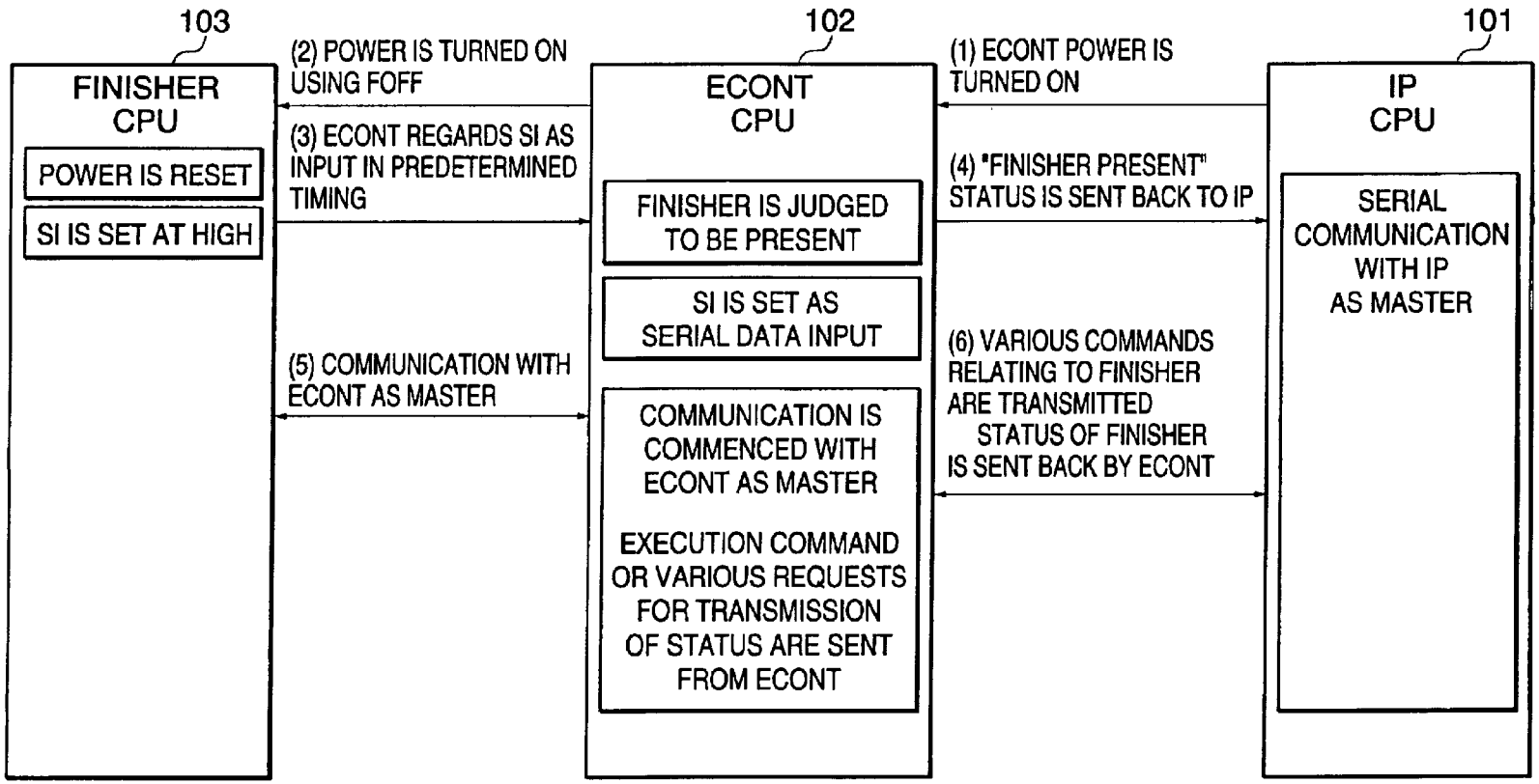
FIG. 7 is a diagram showing the procedure by which the image forming apparatus judges whether the finisher is attached.

FIG. 7 is a block diagram showing how the finisher 23 is detected as being present and also the communication of the status of the finisher 23 between the ECONT 19 and the IP 9 after the finisher 23 has been switched on due to the power supply of the controller (ECONT 19), which controls the image forming unit of the image forming apparatus 500, being switched on by control of the controller (IP9), which controls the entire system comprised of the finisher 23 and the image forming apparatus 500, and the FOFF signal having been switched on by the ECONT 19. This control system is comprised of the CPU 101 of the IP 9, the CPU 102 of the ECONT 19, and the CPU 103 of the finisher 23. The CPU 101 of the IP 9 is in charge of controlling the entire system comprised of the image forming apparatus 500 and the finisher 23. The CPU 102 of the ECONT 19 is in charge of controlling the image forming unit (the developer system, the transfer system, and the fixing system). The CPU 103 of the finisher 23 is in charge of controlling the various parts of the finisher 23.

First, (1) when the CPU 101 of the IP 9 transmits an instruction for turning on the power supply of the ECONT 19 to the CPU 102 of the ECONT 19, the power supply of the ECONT 19 is turned on. Next, (2) the CPU 102 of the ECONT 19 transmits the FOFF signal to the CPU 103 of the finisher 23 to turn on the power supply of the finisher 23. (3) When the CPU 103 of the finisher 23 has set the SI signal at the high level, the CPU 102 of the ECONT 19 regards the SI signal from the finisher 23 as an input in the timing in which the SI signal is set at the high level, and (4) after judging that the SI signal is at the high level, which indicates that the finisher 23 is present, the CPU 102 of the ECONT 19 sends back a status showing that the finisher 23 is present to the CPU 101 of the IP 9. (5) Communication between the CPU 102 of the ECONT 19 and the CPU 103 of the finisher 23 then commences with the ECONT 19 as the master. (6) The CPU 101 of the IP 9 transmits a variety of commands relating to the finisher 23 to the CPU 102 of the ECONT 19, and the CPU 102 of the ECONT 19 sends back the status of the finisher 23 to the CPU 101 of the IP 9.

Figure 8:
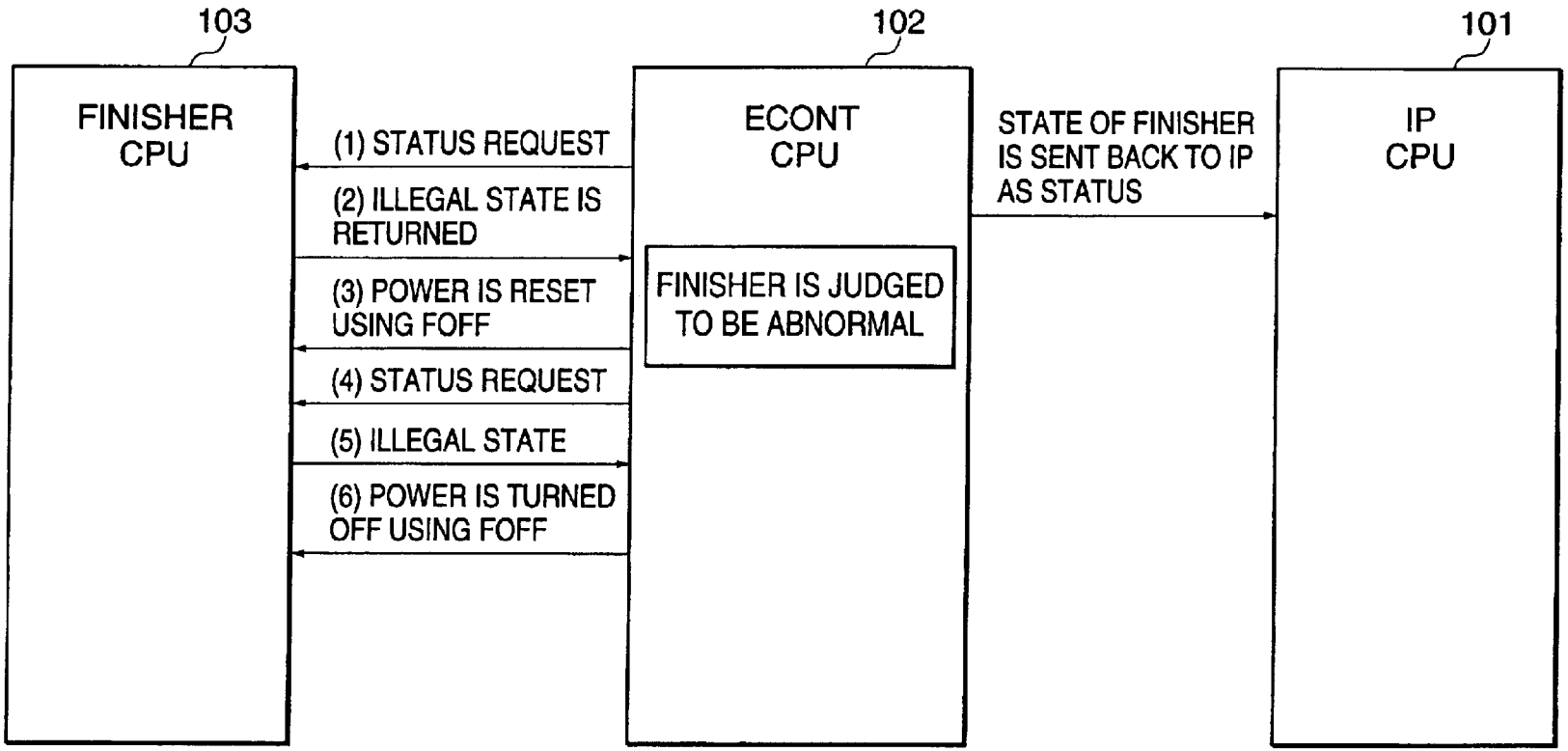
FIG. 8 is a diagram showing the procedure by which the image forming apparatus judges whether the finisher is in an abnormal state.

FIG. 8 is a block diagram showing how the ECONT 19 the ECONT 19 resets the power supply of the finisher 23 via the FOFF signal upon detection of an abnormal state of the finisher 23, and switches the finisher 23 off when the finisher 23 remains in the abnormal state even after the power supply of the finisher 23 has been reset.

First, (1) when the CPU 102 of the ECONT 19 requests the CPU 103 of the finisher 23 to send the status of the CPU 103, (2) the CPU 103 of the finisher 23 sends back an illegal state to the CPU 102 of the ECONT 19. (3) Next, the CPU 102 of the ECONT 19 transmits the FOFF signal to the CPU 103 of the finisher 23 to reset the power supply of the finisher 23, and (4) requests the CPU 103 of the finisher 23 to send the status of the CPU 103. (5) If the CPU 103 of the finisher 23 transmits the illegal state to the CPU 102 of the ECONT 19, (6) the CPU 102 of the ECONT 19 transmits the FOFF signal to the CPU 103 of the finisher 23 to switch off the power supply of the finisher 23. On the other hand, the CPU 102 of the ECONT 19 sends back the state of the finisher 23 as the status to the CPU 101 of the IP 9.

Figure 9:
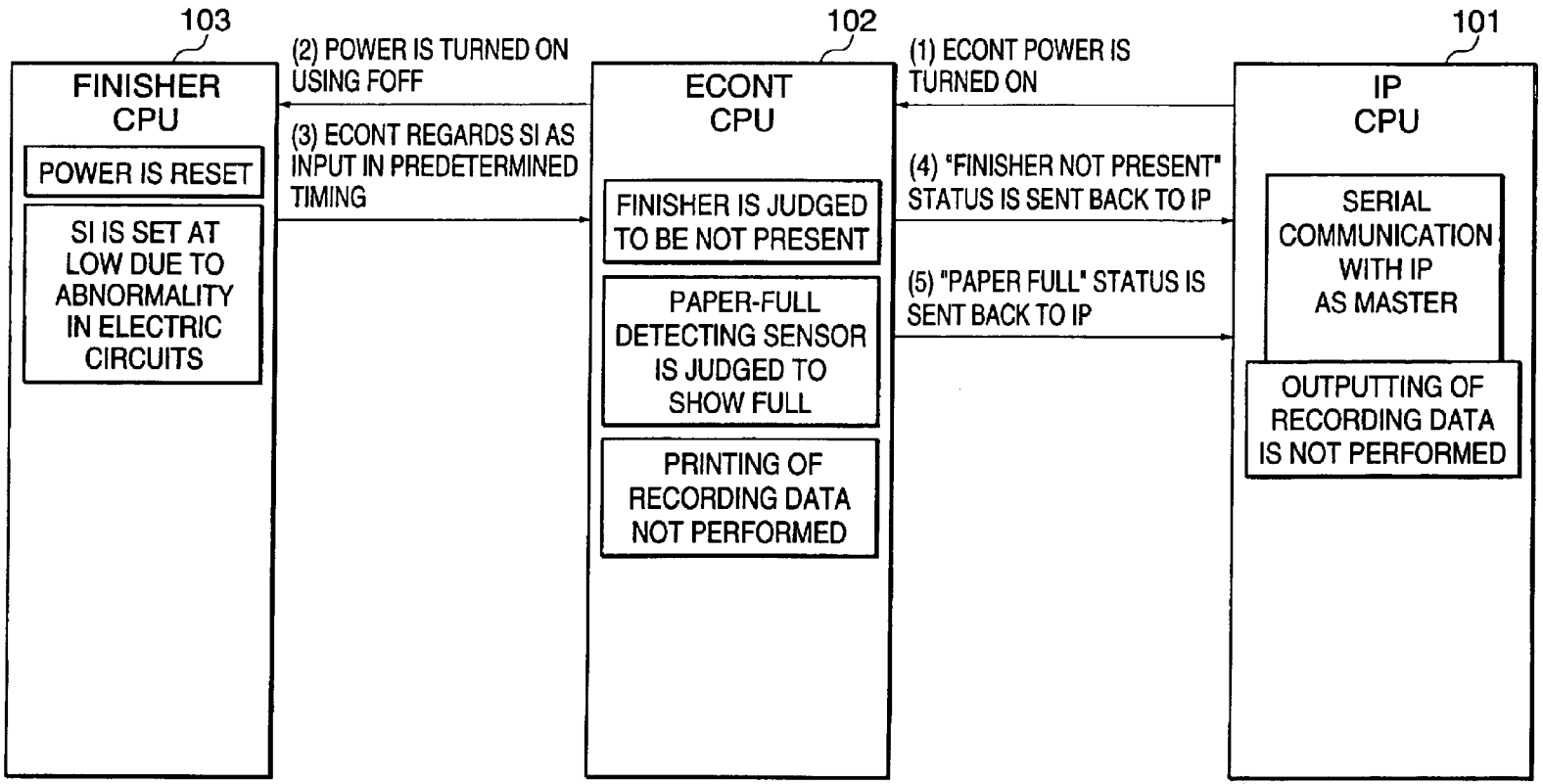
FIG. 9 is also a diagram showing the procedure by which the image forming apparatus judges whether the finisher is in an abnormal state.

FIG. 9 is a block diagram showing how, even in the case where the finisher 23 is physically connected to the finisher 23 but the ECONT 19 judges that the finisher 23 is not present due to the electric circuits of the finisher 23 not operating normally, image formation (recording) is disabled based on a paper-full detection by the paper-full detecting sensor that is removed from the image forming apparatus 500 in order to connect the finisher 23.

First, (1) when the CPU 101 of the IP 9 transmits an instruction for turning on the power supply of the ECONT 19 to the CPU 102 of the ECONT 19, the power supply of the ECONT 19 is turned on. (2) Next, the CPU 102 of the ECONT 19 transmits the FOFF signal to the CPU 103 of the finisher 23 to turn on the power supply of the finisher 23. After this, (3) due to an abnormality in the electric circuits of the finisher 23, the CPU 103 of the finisher 23 sets the SI signal at the low level, that is, turns the transistor 920 off, the CPU 102 of the ECONT 19 regards the SI signal from the finisher 23 as an input in certain timing, and (4) after judging that the finisher 23 is not present, sends back a status of "the finisher 23 is absent" to the IP 9. The CPU 101 of the IP 9 does not output recording data and by using a paper full detection signal from the paper full sensor that is removed from the image forming apparatus 500 in order to connect the finisher 23, the CPU 102 of the ECONT 19 controls the image forming unit so as not to perform printing based on recording data.

The characteristics of the control performed by the CPU 101 of the controller (IP 9) that controls the entire system composed of the image forming apparatus 500 and the finisher 23 according to this embodiment of the present invention, the CPU 102 of the controller (ECONT 19) that controls the image forming part of the image forming apparatus 500, and the CPU 103 of the finisher 23 for controlling the parts of the finisher 23 will be described below.

The CPU 102 of the ECONT 19 transmits and receives information (such as status information and commands) to and from the CPU 103 of the finisher 23 via three-wire serial communication lines, and also controls the power supply of the finisher 23 via the FOFF signal line.

When there has been an instruction for switching to power-saving mode from the CPU 101 of the IP 9, the CPU 102 of the ECONT 19 turns off the high voltage system out of the high voltage system (24V supply) and the low voltage system (5V supply) of the image forming unit of the image forming apparatus 500, in addition to performing control to turn off, via the FOFF signal line, the power supply of the finisher 23, whose power consumption is relatively high.

The CPU 102 of the ECONT 19 also performs control to reset, via the FOFF signal line, a control system including the CPU 103 of the finisher 23.

The CPU 101 of the IP 9 performs control to turn on and off the power supply of the CPU 102 of the ECONT 19, the power supply of the electric components controlled by the CPU 102 of the ECONT 19, and the electric components aside from the control system IC of the finisher 23.

On judging from the communication with the CPU 103 of the finisher 23 that the finisher 23 is in an abnormal state, the CPU 102 of the ECONT 19 performs control via the FOFF signal line to reset the finisher 23.

The CPU 103 of the finisher 23 pulls up the serial input signal as viewed from the ECONT 19 side, out of the three-wire serial communication signals. The CPU 102 of the ECONT 19 sets the FOFF signal at on after the ECONT 19 has been switched on. The power supply of the CPU 103 of the finisher 23 is reset after the control system IC of the finisher 23 is set at on via the FOFF signal and, after this resetting has released, the CPU 103 of the finisher 23 operates so that the level of the serial input signal becomes a high level as viewed from the ECONT 19. The CPU 102 of the ECONT 19 defines the serial input signal as an input port after the power supply of the finisher 23 has been turned on by the FOFF signal, and by monitoring the input port in timing in which the signal level becomes high, performs control so as to judge that the finisher 23 is connected to the image forming apparatus 500.

The CPU 102 of the ECONT 19 also communicates with the CPU 103 of the finisher 23 after confirming that the finisher 23 is connected to the image forming apparatus 500, and performs control to inform the CPU 101 of the IP 9 of the connection of the finisher 23 to the image forming apparatus 500 and of the state of the finisher 23.

When the paper-full detecting sensor (see FIG. 4), which detects whether a discharge tray for recording sheets that have been discharged from the image forming apparatus 500 is full, has been removed from the image forming apparatus 500 in accordance with the connecting of the finisher 23 to the image forming apparatus 500, even if it is judged that the finisher 23 is not connected due to the finisher 23 that has been connected to the image forming apparatus 500 not operating electrically due to an abnormality in the electrical circuits, the CPU 102 of the ECONT 19 still judges that the discharge tray is full of recording sheets in accordance with special logic that is set in advance for the case where the paper-full detecting sensor has been removed, and so performs control so that recording sheets are not discharged to the finisher 23.

Figure 10:
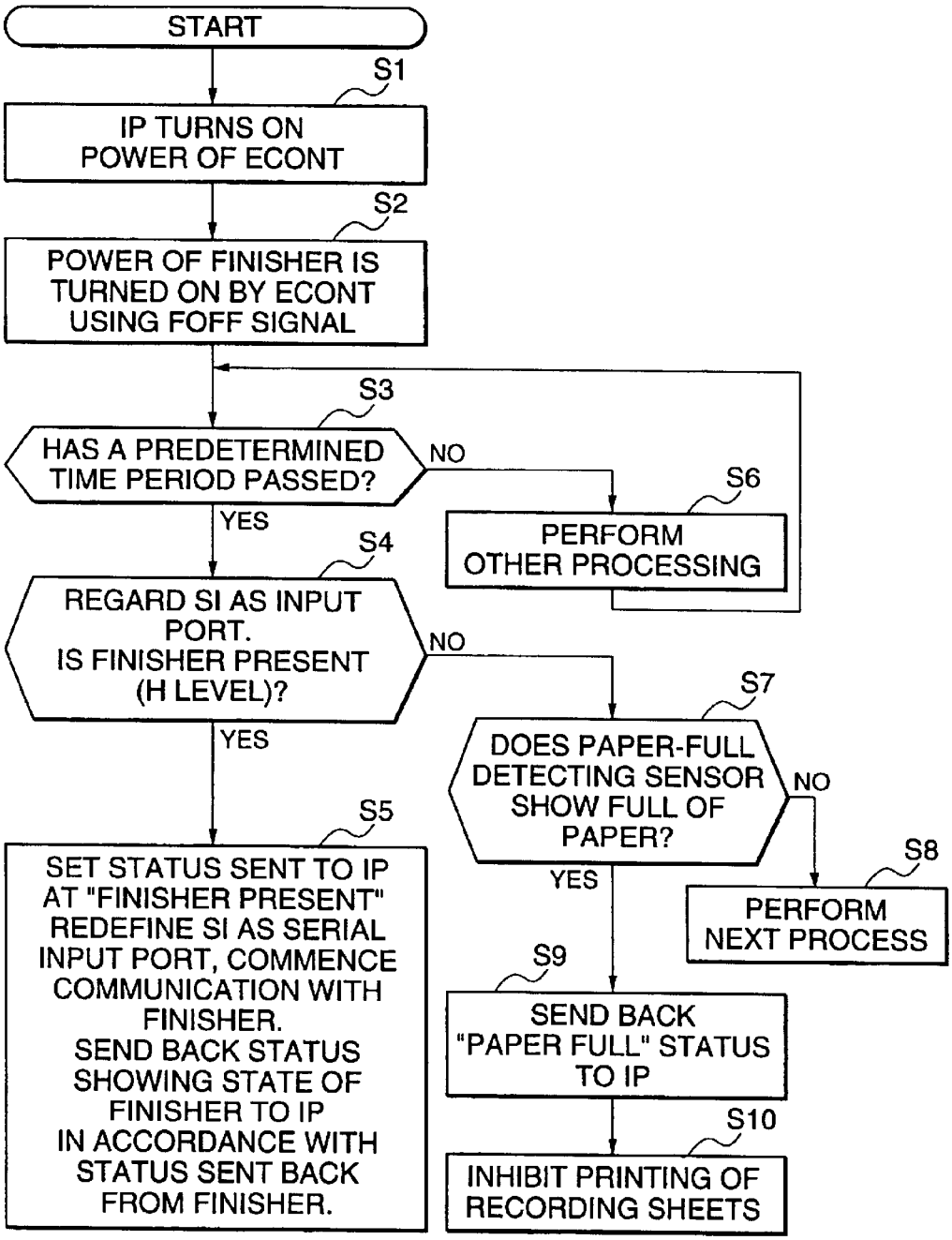
FIG. 10 is a flowchart showing the operation of the image forming apparatus.
Figure 11:
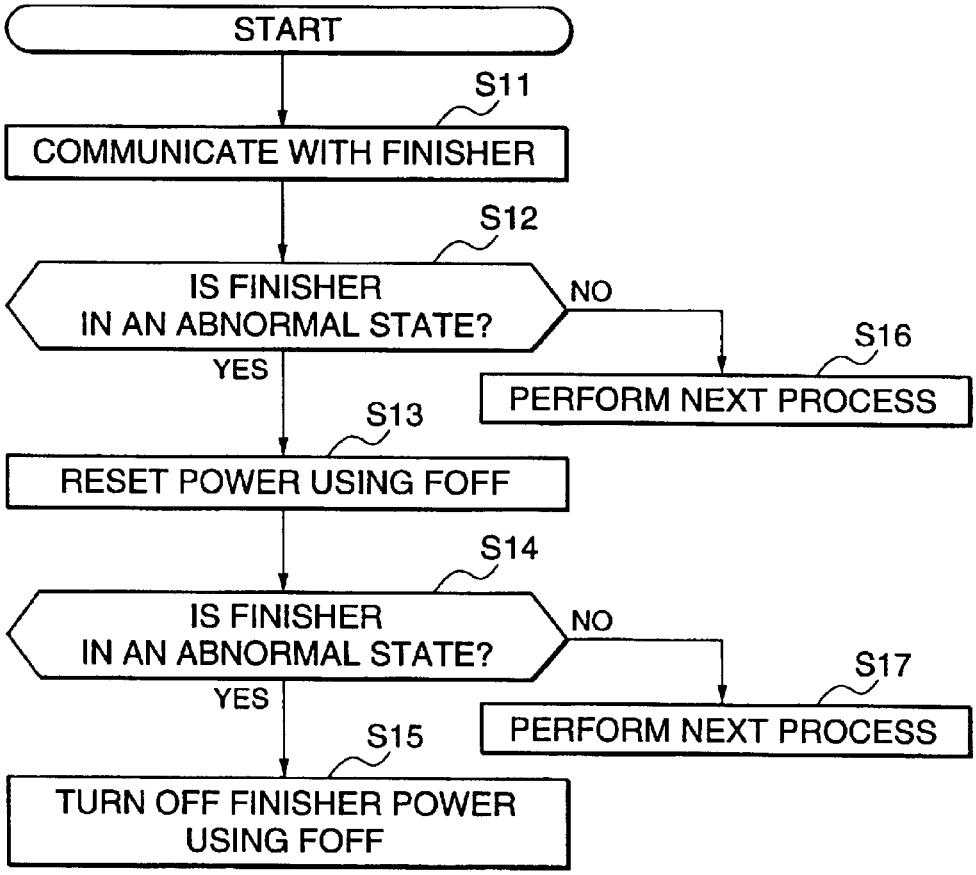
FIG. 11 is a continued part of the FIG. 10 flow chart.

Next the operation of the image forming apparatus 500 according to the present embodiment constructed as above will be described in detail with reference to FIGS. 10 and 11. FIGS. 10 and 11 are flowcharts showing the operation of the image forming apparatus 500 of the present embodiment. The process in these flowcharts is executed based on programs by the controller (IP) 9 that controls the entire system comprised of the image forming apparatus 500 and the finisher 23 and the controller (ECONT) 19 that controls the image forming unit of the image forming apparatus 500.

In FIG. 10, the IP 9 first turns on the power supply of the ECONT 19 (step S1). The ECONT 19 sets the FOFF signal at on, and so turns on the power supply of the finisher 23 (step S2). Next, the ECONT 19 judges whether a predetermined time period has passed since the power supply of the finisher 23 was turned on (step S3). If the predetermined time period has not yet passed, the ECONT 19 performs other processing (step S6), while if the predetermined time period has passed, the ECONT 19 regards the SI signal outputted from the finisher 23 as an input port, and judges whether the finisher 23 is connected (as shown by a high level) to the image forming apparatus 500 (step S4). When the finisher 23 is connected to the image forming apparatus 500, the process proceeds to step S5, while when the finisher 23 is not connected to the image forming apparatus 500, the process proceeds to step S7.

When the finisher 23 is connected to the image forming apparatus 500, the ECONT 19 sets the status sent back to the IP 9 as "finisher present", redefines the SI signal as an input port, and commences communication with the finisher 23. Also, the ECONT 19 sends back status information showing the state of the finisher 23 in accordance with the status reply received from the finisher 23 (step S5). On the other hand, when the finisher 23 is not connected to the image forming apparatus 500, the ECONT 19 determines whether the detection result of the paper-full detecting sensor 823, which detects whether a discharge tray for the discharged recording sheets is full, shows "full" (step S7). When the detection result of the paper-full detecting sensor 823 does not show "full", the ECONT 19 performs other processing (step S8), while when the detection signal from the paper-full detecting sensor 823 shows "full", the ECONT 19 sends back the status "full" to the IP 9 (step S9) and performs control so that printing is not performed on recording sheets (step S10).

Next, in FIG. 11, the ECONT 19 commences communication with the finisher 23 (step S11) and then determines whether the finisher 23 is in an abnormal state (step S12). When the finisher 23 is not in an abnormal state, the ECONT 19 performs the next process (step S16), while when the finisher 23 is in an abnormal state, the ECONT 19 sets the FOFF signal at off and resets the power supply of the finisher 23 (step S13), and determines once again whether the finisher 23 is in an abnormal state (step S14). When the finisher 23 is not in an abnormal state, the ECONT 19 performs the next process (step S17), while when the finisher 23 is in an abnormal state, the ECONT 19 sets the FOFF signal at off and turns off the power supply of the finisher 23 (step S15).

As described above, the CPU 102 of the controller (ECONT) 19 that controls the image forming unit of the image forming apparatus 500 transmits and receives information, such as status information and commands, to and from the CPU 103 of the finisher 23 via three-wire serial communication signals, and when an instruction for a switch to power saving mode is received from the CPU 101 of the controller (IP) 9 that controls the entire system comprised of the image forming apparatus 500 and the finisher 23, the CPU 102 performs control to turn off the high voltage system of the image forming unit and turn off the power supply of the finisher 23 via the FOFF signal, thereby achieving the effects described below.

By providing an FOFF signal that can be reset together with the turning on and off of the control system power supply (5V) of the finisher 23 between the CPU 102 of the controller (ECONT) 19, which controls the image forming unit of the image forming apparatus 500, and the CPU 103, which controls the various parts of the finisher 23, the finisher 23 can be reset and its power supply turned off when the finisher 23 is in an abnormal state with a faster response than is possible with three-wire serial communication signals.

The on/off state of the power system power supply (24V), which is turned off during power saving mode on the image forming apparatus 500 side, is determined according to communication between the controller (ECONT) 19 and the controller (IP) 9, and by controlling the timing in which the control system power supply of the finisher 23 is turned on and off by the controller (ECONT) 19 in accordance with the determined on/off state, erroneous operations of the finisher 23 can be prevented and a power saving mode can be achieved for the image forming apparatus 500 and the finisher 23 by appropriately turning off the power system power supply.

The controller (ECONT) 19 of the image forming apparatus 500 regards the three-wire serial communication input signal as an input port in predetermined timing, so that it can be detected whether the finisher 23 is connected to the image forming apparatus 500 at a low cost without adding a special signal to the interface.

When the controller (ECONT) 19 has detected that the finisher 23 is connected to the image forming apparatus 500, the controller (ECONT) 19 informs the controller (IP) 9 that controls the entire system comprised of the image forming apparatus 500 and the finisher 23 of this fact, so that the finisher 23 can thereafter be controlled from the image forming apparatus 500.

Also, in the case where there is an abnormality in the electric circuits or the like of the finisher 23 so that the finisher 23 that is physically connected to the image forming apparatus 500 does not operate electrically, and the controller (ECONT) 19 has judged that the finisher 23 is not connected to the image forming apparatus 500, there is the possibility of a jam of recording sheets occurring when the recording sheets are discharged from the image forming apparatus 500. However, a construction is used where the paper-full detecting sensor 823 is removed when the finisher 23 is attached to the image forming apparatus 500. When the paper-full detecting sensor 823 has been removed, a discharge tray for the recording sheets is judged as being full in accordance with logic that is set in advance, so that control is performed not to discharge recording sheets from the image forming apparatus 500 to the finisher 23, thereby making it possible to prevent recording sheet jams from occurring.

Other Embodiments

Figure 12:
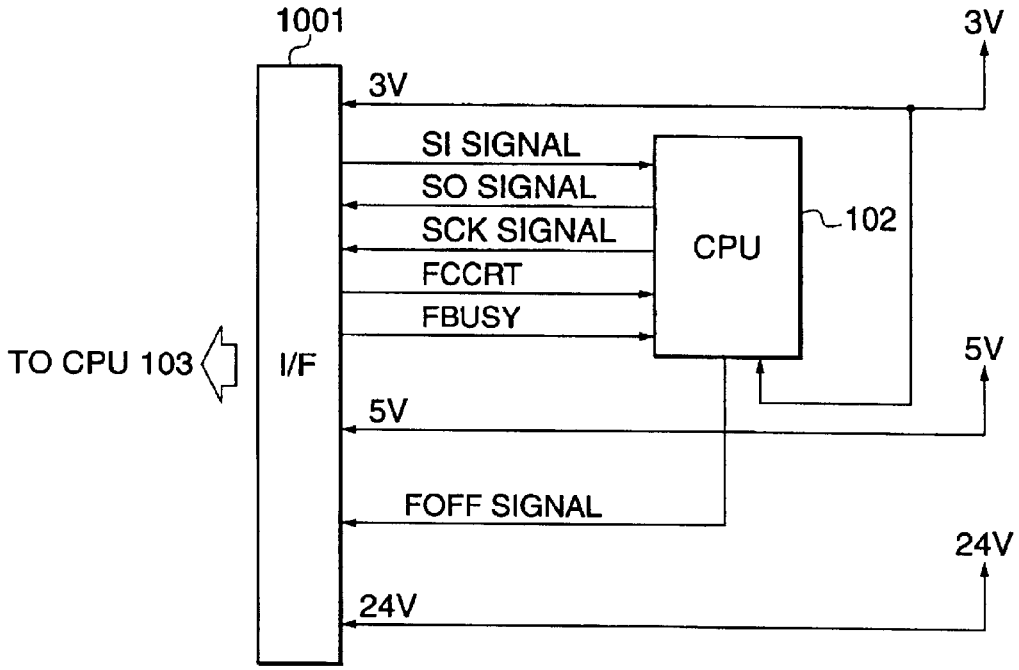
FIG. 12 is a block diagram of the arrangement of components for the control of a finisher 23 according to another embodiment of the present invention.
Figure 13:
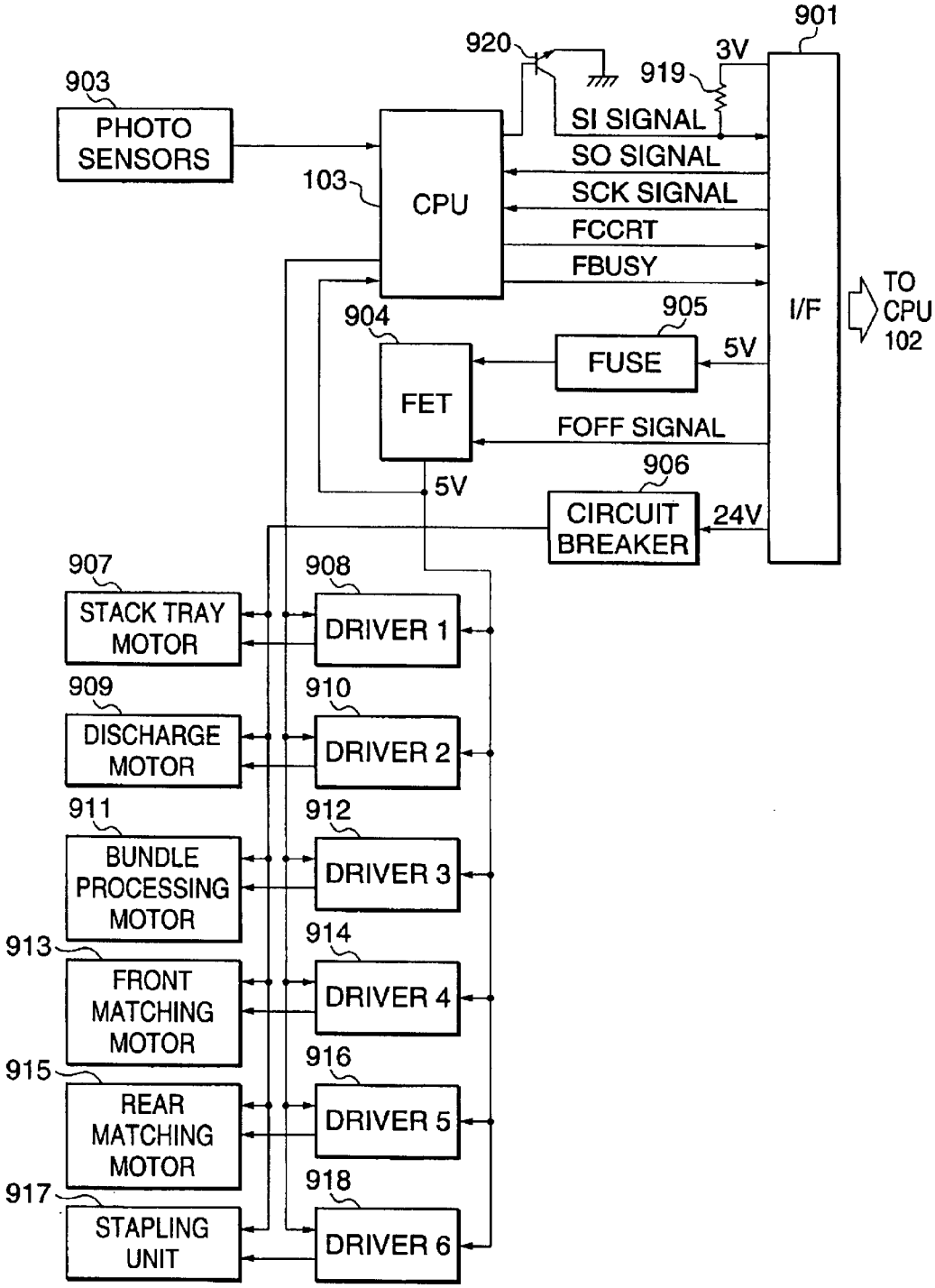
FIG. 13 is a block diagram of the arrangement of components for the control of an image forming apparatus 500 according to the other embodiment.

In the embodiment described above, as shown in FIG. 5 the 5V voltage is applied to the SI signal via the resistor 919. As shown in FIGS. 12 and 13, the voltage that is applied to the SI signal via the resistor 919 may be directly provided via the interfaces 901 and 1001. By this construction, if the CPU 103 operates on a 5V power supply and the CPU 102 operates on a 3V power supply, for example, the high level of the SI signal can be set at 3V not 5V in keeping with the CPU 102.

The above embodiment does not specify a particular kind of image forming apparatus, but the present invention may be applied to any kind of an image forming apparatus with an image forming function (i.e., a printer), an image forming apparatus with an image reading function and an image forming function (i.e., a copier), or an image forming apparatus with a plurality of functions such as an image reading function, an image forming function, and a facsimile function (i.e., a multi-function apparatus).

Although in the above embodiment, the image forming method employed by the image forming apparatus is an electro photocopying method, a variety of other image forming methods aside from the electro photocopying method, such as an ink jet method, a heat transfer method, and an electrostatic method, may be used.

Although in the above embodiment, a finisher, an inner discharge tray, and an option feeder are given as examples of options that can be detachably connected to the image forming apparatus, the present invention may be applied to options with functions aside from those of the options given above.

It should be noted that the present invention may either be applied to a system composed of a plurality of apparatuses or to a single apparatus. It is to be understood that the object of the present invention may also be accomplished by supplying a system or an apparatus with a storage medium or other medium in which a program code of software which realizes the functions of the above described embodiments is stored, and causing a computer (or CPU or MPU) of the system or apparatus to read out and execute the program code stored in the storage medium or other medium.

In this case, the program code itself read from the storage medium or other medium realizes the functions of the embodiments described above, and hence the storage medium or other medium on which the program code is stored constitutes the present invention. Examples of the storage medium or other medium for supplying the program code include a floppy (registered trademark) disk, a hard disk, an optical disk, a magnetic-optical disk, a CD-ROM, a CD-R, a CD-RW, DVD-ROM, a DVD-RAM, a DVD-RW, a DVD+RW, a magnetic tape, a nonvolatile memory card, a ROM, or a download performed via a network.

Further, it is to be understood that the functions of the above described embodiments may be realized not necessarily by causing the computer to read and execute the program code, but also by causing an OS (operating system) or the like which operates on the computer to perform a part or all of the actual operations based on instructions of the program code.

Further, it is to be understood that the functions of the above described embodiments may be accomplished by writing a program code read out from the storage medium into an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. A sheet processing apparatus to be attached to an image forming apparatus, comprising:

a controller that controls the sheet processing apparatus; and a serial communication line that performs serial communication from said controller to the image forming apparatus, wherein said controller sets said serial communication line to a high level before performing serial communication through said serial communication line, in response to supplying of power to said controller.

2. A sheet processing apparatus according to claim 1, comprising a resistor, and a first switching element, and wherein said serial communication line is disposed such that a voltage is applied to said serial communication line via said resistance, said serial communication line is grounded via said first switching element, and said controller controls said first switching element.

3. A sheet processing apparatus according to claim 2, wherein said controller sets said serial communication line at the high level by turning off said first switching element.

4. A sheet processing apparatus according to claim 3, wherein said controller performs serial communication with the image forming apparatus by turning said first switching element on and off.

5. A sheet processing apparatus according to claim 2, wherein said first switching element comprises a transistor.

6. A sheet processing apparatus according to claim 2, wherein said serial communication line is disposed relative to the image forming apparatus such that a voltage of a power supply supplied by the image forming apparatus is applied to said serial communication line via said resistance.

7. A sheet processing apparatus according to claim 4, comprising a second switching element, and wherein power supplied from the image forming apparatus is supplied to said controller and said serial communication line via said second switching element, and wherein said second switching element is controlled in accordance with a signal on a power supply control signal line from the image forming apparatus.

8. A sheet processing apparatus according to claim 7, wherein said second switching element comprises a field effect transistor (FET).

9. A sheet processing apparatus according to claim 1, further comprising a second serial communication line that performs serial communication from the image forming apparatus to said controller.

10. A sheet processing apparatus according to claim 1, wherein the image forming apparatus is responsive to supplying of the power to said controller, for determining whether said serial communication line is at the high level, and determines that the sheet processing apparatus is attached when said serial communication line is at the high level.

11. A sheet processing apparatus according to claim 10, wherein the image forming apparatus judges whether said serial communication line is at the high level after a predetermined time period has passed after the power has been supplied to the controller.

12. An image forming apparatus to which the sheet processing apparatus according to claim 1 is attached, comprising:

a second controller that controls the image forming apparatus;

wherein said serial communication line performs serial communication from the sheet processing apparatus to said second controller; and wherein said second controller is responsive to supplying of power to the sheet processing apparatus, for determining whether said serial communication line is at a high level, and determines that the sheet processing apparatus is attached when said second serial communication line is at the high level.

13. An image forming apparatus according to claim 12, wherein the second controller determines whether said serial communication line is at the high level after a predetermined time period has passed after the power has been supplied to the sheet processing apparatus.

14. An image forming apparatus according to claim 12, comprising a power supply control signal line, and wherein said second controller controls supplying of the power to the sheet processing apparatus via said power supply control signal line, and wherein said second controller determines whether said serial communication line is at the high level after instructing the supplying of the power to the sheet processing apparatus via said power supply control signal line.

15. An image forming apparatus according to claim 14, wherein upon returning from a power saving mode, said second controller instructs the supplying of the power to the sheet processing apparatus via said power supply control signal line and then determines whether said serial communication line is at the high level.

16. An image forming apparatus according to claim 12, further comprising a second serial communication line that performs serial communication from said second controller to the sheet processing apparatus.

17. An image forming apparatus to which the sheet processing apparatus is attached, comprising:

a controller that controls the image forming apparatus; and a serial communication line that performs serial communication from the sheet processing apparatus to said controller, wherein said controller determines whether said serial communication line is at a high level before performing communication through said serial communication line, in response to supplying of power to the sheet processing apparatus, and determines that the sheet processing apparatus is attached when said serial communication line is at the high level.

18. A sheet processing apparatus to be attached to an image forming apparatus, comprising:

a controller that controls the sheet processing apparatus; and a serial communication line that performs serial communication from said controller to the image forming apparatus, wherein said controller controls a voltage applied to said serial communication line such that a predetermined voltage is applied to said serial communication line before performing serial communication through said serial communication line, in response to supplying of power to said controller.

19. An image forming apparatus to be attached to a sheet processing apparatus, comprising:

a controller that controls the image forming apparatus; and a serial communication line that performs serial communication from the sheet processing apparatus to said controller, wherein said controller determines whether a predetermined voltage is applied to said serial communication line before performing serial communication through said serial communication line, in response to supplying of power to the sheet processing apparatus, and determines that the sheet processing apparatus is attached when the predetermined voltage is applied to said serial communication line.

* * * * *